US005853009A

United States Patent [19]

Yu

[11] Patent Number: 5,853,009

[45] Date of Patent: Dec. 29, 1998

[54] HAIR PIECE AND METHOD OF MAKING SAME

[76] Inventor: Jackie Yu, 8112 W. Third St., Los Angeles, Calif. 90048

[21] Appl. No.: 805,751

[22] Filed: Feb. 25, 1997

[51] Int. Cl.[6] ..... A41G 5/00

[52] U.S. Cl. ..... 132/201; 132/54

[58] Field of Search ..... 132/201, 53, 54, 132/55, 56

[56] References Cited

U.S. PATENT DOCUMENTS

| | | | |
|---|---|---|---|
| 2,233,100 | 2/1941 | Jevnikar | 132/53 |
| 2,814,301 | 11/1957 | Schmitz | 132/201 |
| 3,307,563 | 3/1967 | Regina | 132/53 |
| 3,420,249 | 1/1969 | Bonham | 132/201 |
| 3,835,868 | 9/1974 | Heck | 132/201 |
| 3,968,807 | 7/1976 | Kraicer | 132/53 |
| 4,296,765 | 10/1981 | Bachtell | 132/53 |
| 4,517,999 | 5/1985 | Finamore | 132/201 |
| 5,592,957 | 1/1997 | Gazerro et al. | 132/53 |

FOREIGN PATENT DOCUMENTS

| | | | |
|---|---|---|---|
| 93003635 | 3/1993 | WIPO | 132/201 |

*Primary Examiner*—Todd E. Manahan
*Assistant Examiner*—Eduardo C. Robert
*Attorney, Agent, or Firm*—James E. Brunton

[57] ABSTRACT

A lightweight, natural appearing hair piece which can be used to cover bald spots and create the appearance of a natural, fullbodied head of hair. The hair piece is constructed from a multiplicity of strands of human hair that are uniquely affixed to a front piece and a net-like base which, in turn, can be easily affixed to the user's scalp using a connector strip and conventional skin adhesive.

11 Claims, 3 Drawing Sheets

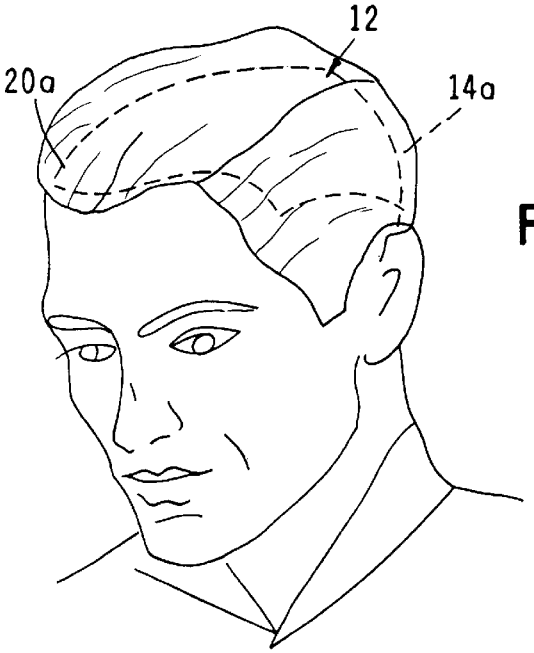
FIG. 1
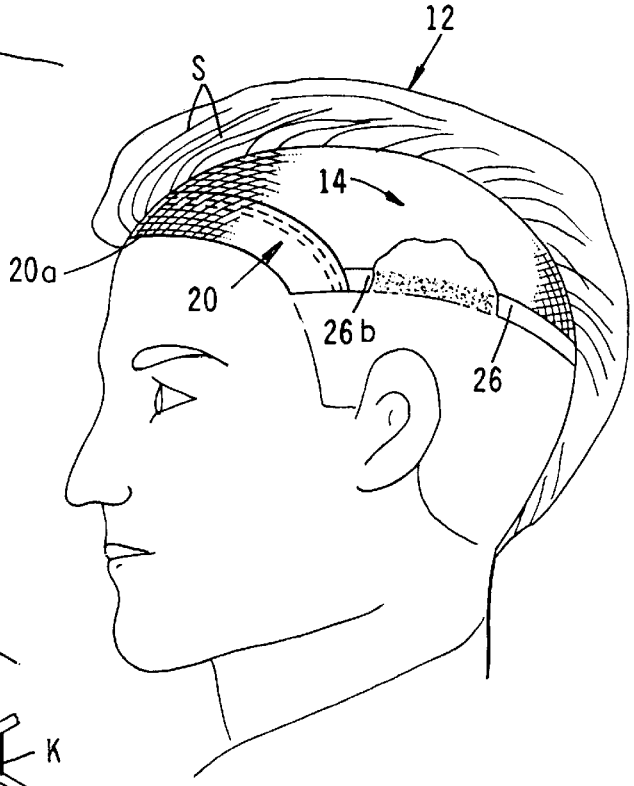
FIG. 2
FIG. 4
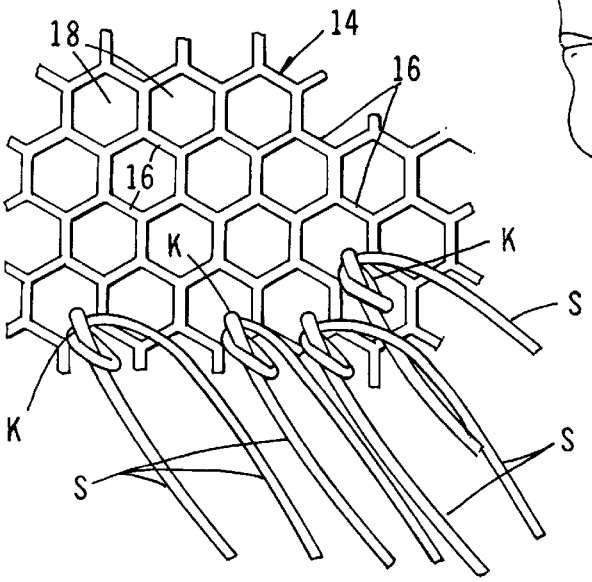

HAIR PIECE AND METHOD OF MAKING SAME

BACKGROUND OF THE INVENTION

1. Field of the Invention

The present invention relates generally to hair pieces. More particularly, the invention concerns a lightweight, close-fitting toupee constructed from a multiplicity of strands of human hair.

2. Discussion of the Invention

Hair pieces for covering bald spots are old. For many years such devices have been used by both men and women to compensate for hair loss. Often synthetic fibers having the appearance of human hair are used in the construction of toupees or wigs which are adapted to overlay the area of baldness or hair thinning. Such fibers are typically affixed to a relatively heavy backing of some kind and the backing is either removably affixed to the user's scalp using an adhesive or is held in position by hair pins or the like.

Poorly constructed hair pieces typically do not properly blend with the user's hair and, therefore, are often obvious and most unattractive. Additionally, such hair pieces tend to be bulky, poor fitting, difficult to use and exhibit poor wear characteristics. In sharp contradistinction, the hair piece of the present invention uses natural hair which attractively blends with the user's hair. The hair is uniquely affixed to a lightweight, three-piece base assemblage that readily conforms to the contour of the user's scalp so that, when the hair piece is in use, it appears completely natural. Because the strands of natural hair are affixed to the base assemblage one or two at a time, the hair can be combed and styled in the same manner as the user's natural hair. A yieldably deformable plastic strip, which is provided along the perimeter of the base assemblage, is used to removably bond the hair piece to the user's scalp using a conventional skin adhesive.

SUMMARY OF THE INVENTION

It is an object of the present invention to provide a lightweight, natural appearing and highly attractive hair piece which can be used to cover bald spots and create the appearance of a natural, fullbodied head of hair.

It is another object of the invention to provide a hair piece of the aforementioned character which is constructed from a multiplicity of strands of human hair that are uniquely affixed to a net-like base which, in turn, can be easily affixed to the user's scalp.

Another object of the invention is to provide a hair piece of the character described which is easy to use, can readily be fitted and styled and is extremely durable in use.

Another object of the invention is to provide a hair piece of the type described in the preceding paragraphs in which the strands of human hair are individually tied to a base assemblage which is constructed of three uniquely configured components that, when joined together from an assemblage which precisely conforms to the shape of the user's scalp.

Another object of the invention to provide a hair piece of the aforementioned character which is of high quality and yet is relatively inexpensive.

BRIEF DESCRIPTION OF THE DRAWINGS

FIG. 1 is a generally perspective view of a person wearing one form of hair piece of the invention.

FIG. 2 is a side view of the individual wearing the hair piece partly broken away to better show construction of the hair piece.

FIG. 4 is a greatly enlarged, fragmentary view of the area identified in FIG. 3 as 4—4.

DESCRIPTION OF THE INVENTION

Figure 3:
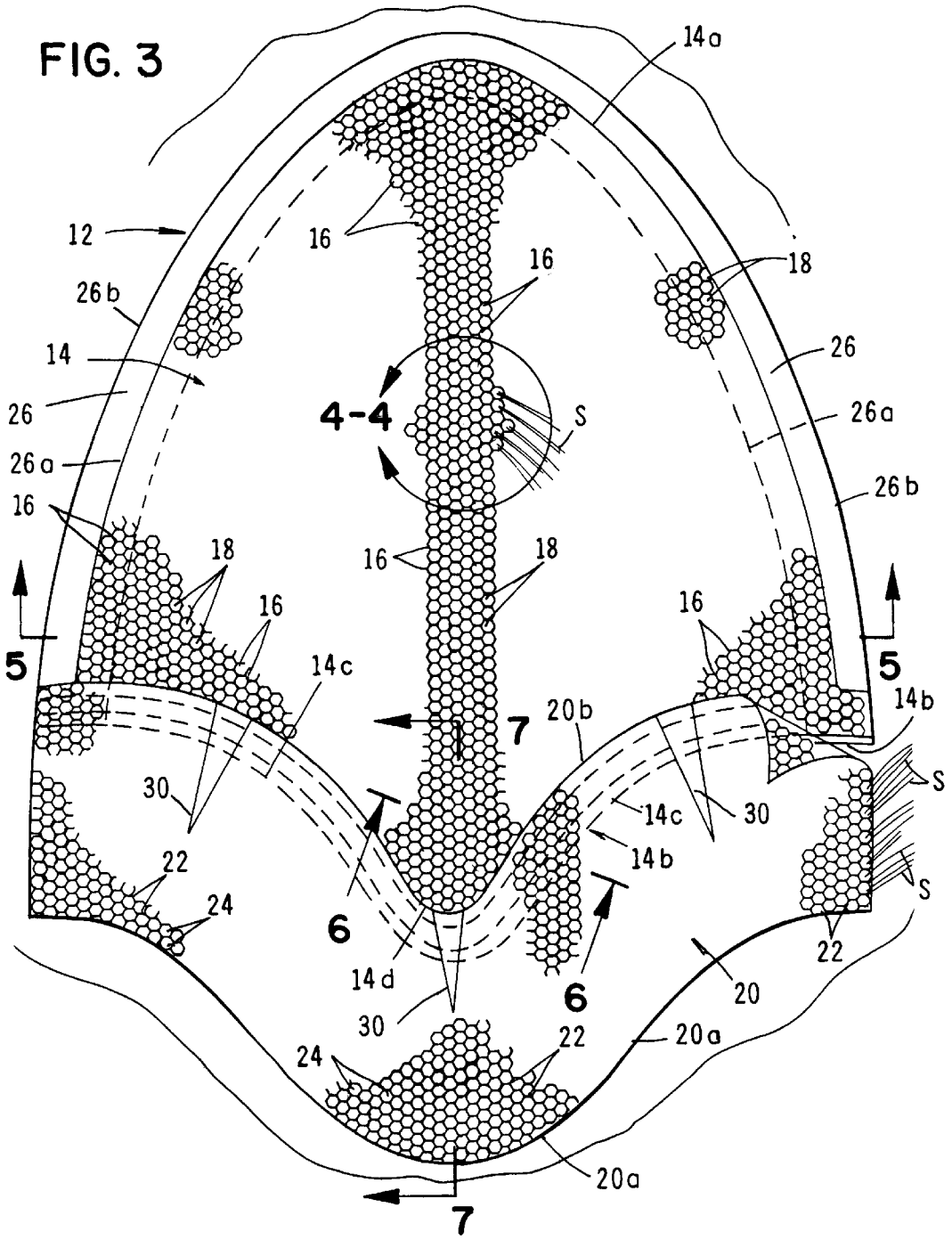
FIG. 3 is an enlarged, plan view of one form of the hair piece of the invention.
Figure 5:
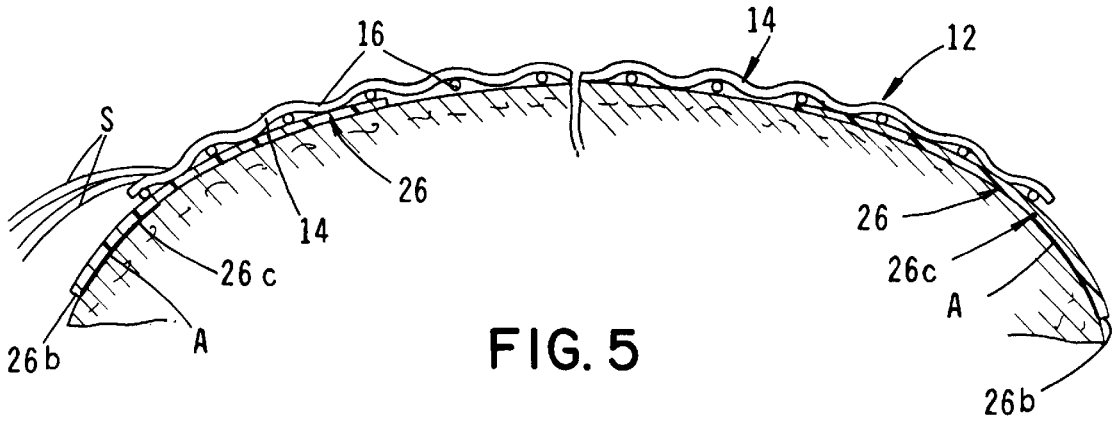
FIG. 5 is a cross-sectional view taken along lines 5—5 of FIG. 3.

Referring to the drawings and particularly to FIGS. 1 through 3, one form of the hair piece of the present invention is there illustrated and generally designated by the numeral 12. As best seen in FIG. 2, the hair piece covers a portion of the user's scalp and here comprises a very thin, lightweight, net-like base 14 which, as shown in FIG. 3, is preferably constructed from a multiplicity of interconnected filaments or fibers 16 which, when interconnected, form a multiplicity of generally hexagonal-shaped openings or interstices 18. Base 14 has a generally parabolic-shaped rear edge 14*a* and a uniquely curved front edge 14*b*. As indicated in FIG. 3, front edge 14*b* has the general shape of a curtate cycloid and includes curved side portions 14*c* which terminate in the curved central portion 14*d* of the cycloid.

A net-like front piece 20 having a front edge 20*a* is also constructed from a multiplicity of interconnected filaments 22 which, when interconnected, form a multiplicity of hexagonal-shaped openings or interstices 24. As indicated in FIG. 3, the front edge 20*b* of front piece 20 overlaps and is interconnected with front edge 14*b* of base 14. These components may be interconnected by sewing as indicated in FIG. 3 or by any other suitable means such as adhesive bonding or the like.

The third component of the hair piece of the form of the invention shown in the drawings comprises a flexible connector strip 26 which includes spaced-apart first and second edges 26*a* and 26*b* respectively. Connector strip 26 is preferably on the order of one-half to one inch wide and is preferably constructed of a flexible plastic material such as polyurethane. Connector strip 26 functions to interconnect the hair piece with the scalp of the user in the manner shown in FIG. 2 and is interconnected with and extends about the perimeter of base 14 in the manner best shown in FIG. 3.

In using the hair piece of the invention, the connector strip 26 can be connected to the scalp by a conventional, readily commercially available skin adhesive which is applied to the lower smooth surface of the connector strip and is then secured to the scalp by pressing the area with a comb or the like. Once again, connector strip can be interconnected with base 14 by any suitable means such as sewing, adhesive bonding or the like.

Turning to FIG. 4, an extremely important aspect of the hair piece of the present invention is there illustrated. More particularly, as shown in FIG. 4, at least one individual strand of hair "S" is connected to each of the filaments 16. More particularly, a multiplicity of individual strands "S" of human hair are connected to the individual filaments 16 of base 14 by inserting one end of the strand of hair through a selected hexagonal-shaped opening and then forming a knot "K" in the strand in the manner shown in FIG. 4. Preferably a single strand of hair is interconnected with a selected filament 16. However, it is possible in some instances to interconnect two strands of hair to a selected filament by passing both ends of the strand of hair through an opening 18 and then tying a knot in the two strands of hair so as to securely interconnect the strands "S" with the selected filament 16.

Figure 6:
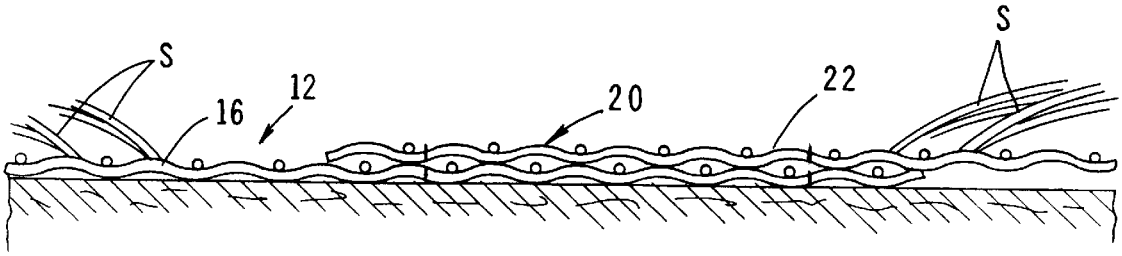
FIG. 6 is an enlarged, cross-sectional view taken along lines 6—6 of FIG. 3.
Figure 7:
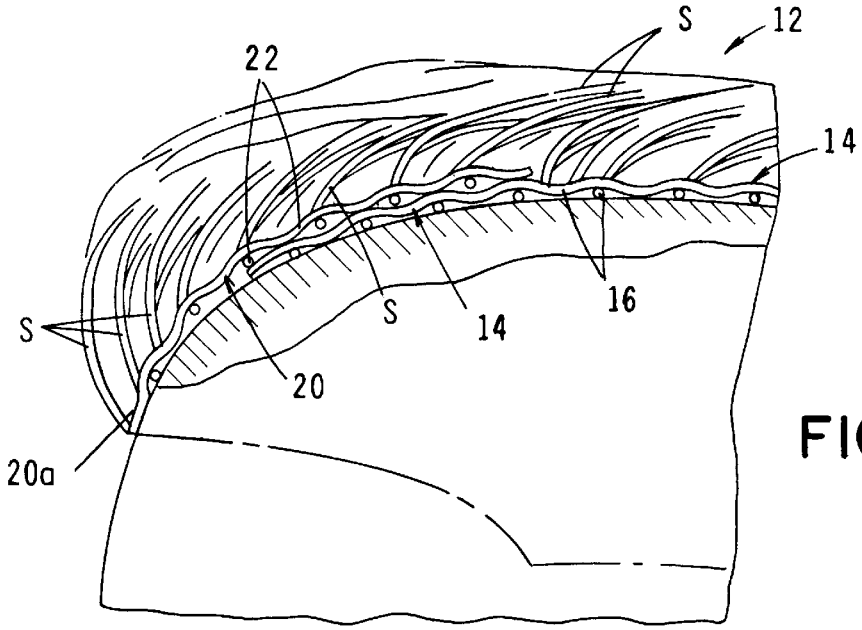
FIG. 7 is an enlarged, cross-sectional view taken along lines 7—7 of FIG. 3.

In constructing the novel hair piece of the invention, a plurality of generally "V" shaped tucks 30 are formed in front piece 20 in circumferentially spaced-apart locations as indicated in FIG. 3. Tucks 30 are constructed by folding the net-like fabric so that it is doubled upon itself in the manner shown in FIG. 3. Tucks 30 uniquely function to create and maintain the desired shape of the hair piece so that it will smoothly and accurately conform to the user's scalp in the manner illustrated in FIG. 2. After tucks 30 are made, the front piece 20 is preferably interconnected to base 14 by. hand stitching so as to secure the two components together in a dome-like configuration which precisely conforms to the shape of the user's head (see FIGS. 2, 6, and 7).

Following interconnection of the front piece 20 with the base 14, connector strip. 26 is interconnected with base 14 along its perimeter in the manner shown in FIG. 3. Following interconnection together of the three major components of the hair piece, namely the base 14, the front piece 20 and the connector means or connector strip 26, the strands of hair are securely tied to the individual fibers that make up the front piece and base of the hair piece of the invention. As previously mentioned, this tying is done in the manner shown in FIG. 4 by inserting one free end of the stand of hair through an opening 18 or 24 and then knotting the strand of hair about a selected filament so as to securely attach the stands of hair one by one to the base and front piece of the device.

Once the strands of hair are interconnected with the base 14 and front piece 20, the assemblage thus formed can be affixed to the user's scalp by coating the under surface 26*a* of connector strip with a suitable skin adhesive "A" and then placing the hair piece over the scalp in the manner shown in FIG. 2 and pressing the connector strip against the scalp using a comb or like instrument. After the hair piece has been secured in place over the user's scalp, the hair can be combed and styled in virtually the same manner as is the natural hair of the user. When in place, the hair piece looks completely natural and being extremely lightweight and close fitting is extremely comfortable for the user. The tucked interconnection of the front piece and the base forms a uniquely dome-shaped supporting structure which readily conforms to the shape of the user's head and, when in place, is virtually undetectable to the sight or feel.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A hairpiece for covering a portion of the user's scalp, comprising:

(a) a base having a generally parabolic-shaped rear edge and a curved front edge comprising curved side portions terminating in a generally cycloid-shaped central portion;

(b) a front piece having spaced-apart, curved front and rear edges, said rear edge being connected to said front edge of said base said front piece comprising a net-like fabric having a plurality of folds disposed proximate said rear edge thereof;

(c) connector means for connecting said base to the user's scalp, said connector means comprising a flexible connector member having first and second spaced-apart, generally parabolic-shaped edges, said first edge being connected to said rear edge of said base; and (d) a multiplicity of strands of human hair connected to said base and to said front piece.

2. A hairpiece as defined in claim 1 in which said base comprises a net-like fabric constructed from a multiplicity of filaments interconnected together to form a multiplicity of interstices, said strands of hair passing through said interstices and being connected to said filaments.

3. A hairpiece as defined in claim 1 in which said connector strip comprises a flexible plastic strip having a smooth scalp engaging surface.

4. A hairpiece for covering a portion of the user's scalp, comprising:

(a) a net-like base constructed from a multiplicity of interconnected filaments, said base having a generally parabolic-shaped rear edge and a curved front edge comprising curved side portions terminating in a curved central portion;

(b) a net-like front piece constructed from a multiplicity of interconnected filaments, said front piece having spaced-apart, curved front and rear edges, said rear edge being connected to said front edge of said net base, said front Piece including a plurality of spaced apart, generally "V" shaped tucks located proximate said rear edge;

(c) a flexible connector strip connected to said rear edge of said base, said connector strip having first and second spaced-apart, curved edges; and (d) a multiplicity of individual strands of human hair connected to said base and to said front piece.

5. A hairpiece as defined in claim 4 in which said filaments interconnected together to form a multiplicity of generally hexagonally shaped openings, said individual strands of hair passing through said openings and being connected to said filaments.

6. A hairpiece as defined in claim 5 in which at least one individual strand of hair is connected to each of said filaments.

7. A hairpiece as defined in claim 6 in which said strands of hair are attached to each of said filaments by forming a connecting knot proximate one end of the strand of hair.

8. A method of making a hairpiece comprising a net-like base having a front edge and a rear edge, a net-like front piece, a rear-edge connector strip and a multiplicity of strands of human hair, said method comprising the steps of:

(a) forming a plurality of spaced-apart tucks in said front piece proximate said rear edge thereof;

(b) connecting said rear edge of said front piece to said front edge of said base to form a scalp covering generally dome-shaped assemblage;

(c) connecting said connector strip to said rear edge of said base; and (d) tying each said strand of human hair to said scalp covering assemblage.

9. A method as defined in claim 8 in which said net-like base and said net-like front piece are constructed from a multiplicity of filaments interconnected together to form a multiplicity of openings said method comprising the step of inserting each said strand of hair into a selected one of said openings and then tying the strand of hair to one of the filaments defining the opening.

10. A hairpiece for covering a portion of the user's scalp, comprising:

(a) a base having a generally parabolic-shaped rear edge and a curved front edge comprising curved side portions terminating in a generally cycloid-shaped central portion;

(b) a front piece having spaced-apart, curved front and rear edges, said rear edge being connected to said front edge of said base, said front piece comprising a net-like fabric and including a plurality of spaced-apart folds disposed proximate said rear edge thereof, said folds being made by doubling said fabric upon itself;

(c) connector means for connecting said base to the user's scalp, said connector means comprising a flexible connector member having first and second spaced-apart, generally parabolic-shaped edges, said first edge being connected to said rear edge of said base; and (d) a multiplicity of strands of human hair connected to said base and to said front piece.

11. A hairpiece for covering a portion of the user's scalp, comprising:

(a) a net-like base constructed from a multiplicity of interconnected filaments, said filaments being interconnected together to form a multiplicity of generally hexagonal-shaped openings, said base having a generally parabolic-shaped rear edge and a curved front edge comprising curved side portions terminating in a curved central portion;

(b) a net-like front piece constructed from a multiplicity of interconnected filaments, said front piece having spaced-apart, curved front and rear edges, said rear edge being connected to said front edge of said net-like base and including a plurality of spaced-apart folds disposed proximate said rear edge thereof, said folds being made by doubling said front piece upon itself;

(c) a flexible connector strip connected to said rear edge of said base, said connector strip having first and second spaced-apart, curved edges; and (d) a multiplicity of individual strands of human hair passing through said generally hexagonally shaped openings of said net-like base and being connected to said base and to said front piece, at least one individual strand of hair being connected to each of said filaments.

* * * * *